United States Patent [19]

Goran, Jr.

[11] 4,221,331

[45] Sep. 9, 1980

[54] ATOMIZING APPARATUS

[76] Inventor: Leo Goran, Jr., 6345 Westmoor, Birmingham, Mich. 48010

[21] Appl. No.: 14,974

[22] Filed: Feb. 26, 1979

[51] Int. Cl.[3] ..... B05B 7/32

[52] U.S. Cl. ..... 239/121; 239/214.25; 239/373

[58] Field of Search ..... 239/77, 214, 214.11, 239/214.15, 214.17, 214.21, 214.25, 215, 222, 222.11, 223, 224, 337, 373, 380, 424, 424.5, 120, 121

[56] References Cited

U.S. PATENT DOCUMENTS

| | | | |
|---|---|---|---|
| 417,714 | 12/1889 | Exley | 239/224 X |
| 1,547,802 | 7/1925 | Gasstrom | 239/215 |
| 2,922,583 | 1/1960 | Perkins | 239/215 |

FOREIGN PATENT DOCUMENTS

| | | | |
|---|---|---|---|
| 180010 | 10/1935 | Switzerland | 239/214 |

*Primary Examiner*—Andres Kashnikow

*Attorney, Agent, or Firm*—Olsen and Stephenson

[57] ABSTRACT

Apparatus for converting a liquid into an atomized mist and, in one form of the invention discharging the mist to the atmosphere, in another form of the invention discharging the mist into an air stream for spraying the mist onto a receiving surface, and in still another form of the invention discharging the mist in a selected pattern of spray onto a receiving surface without the use of an air stream. The liquid is converted into an atomized mist by a mechanical operation wherein the liquid is fed through orifices in a spray head and a blade is moved rapidly over the orifices so as to shear particles of liquid from the main stream and discharge them therefrom as a fine mist. The airstream can be generated by a fan that is part of the apparatus and is driven by an electrical motor that actuates the blade, or the airstream can be generated by a second source of energy located remotely of the apparatus.

23 Claims, 14 Drawing Figures

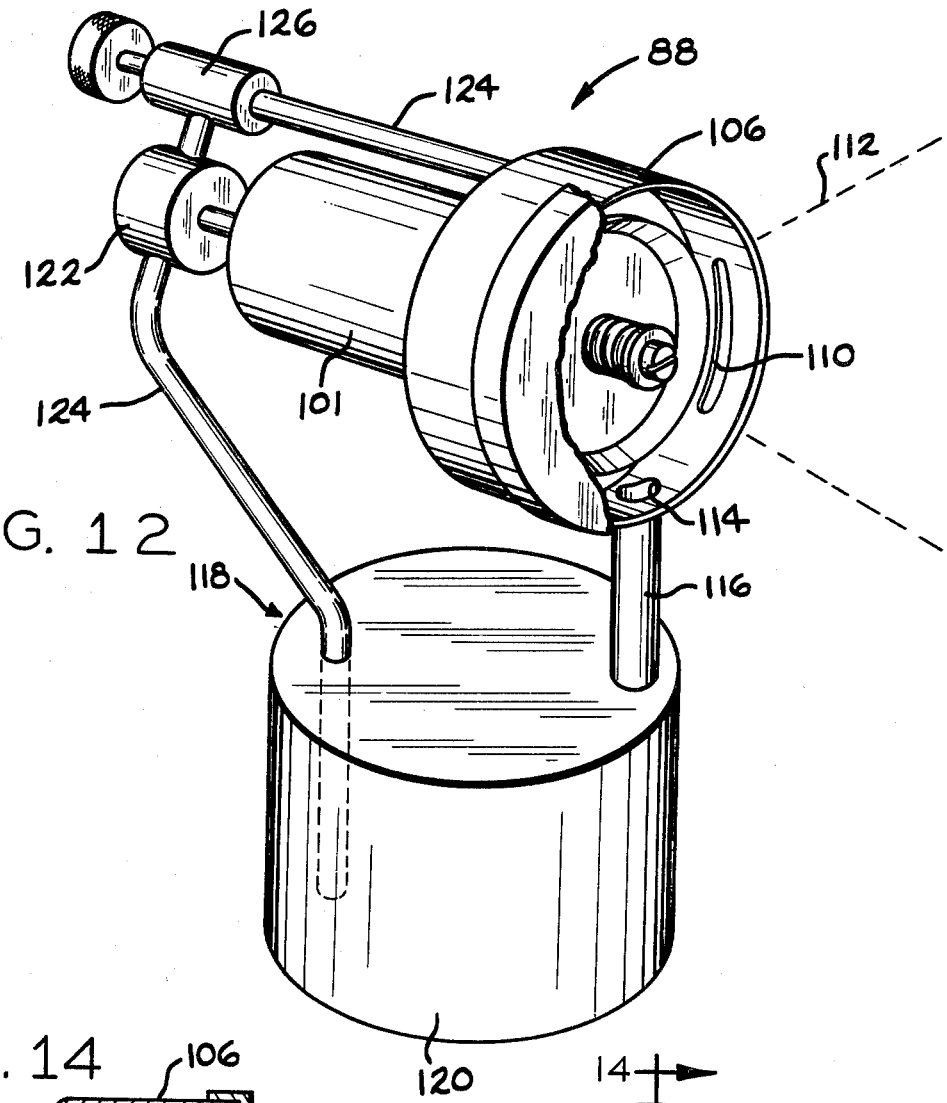
FIG. 12
FIG. 14
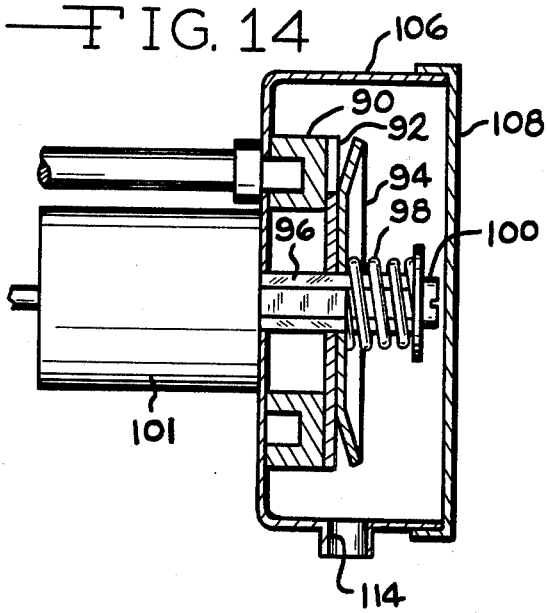
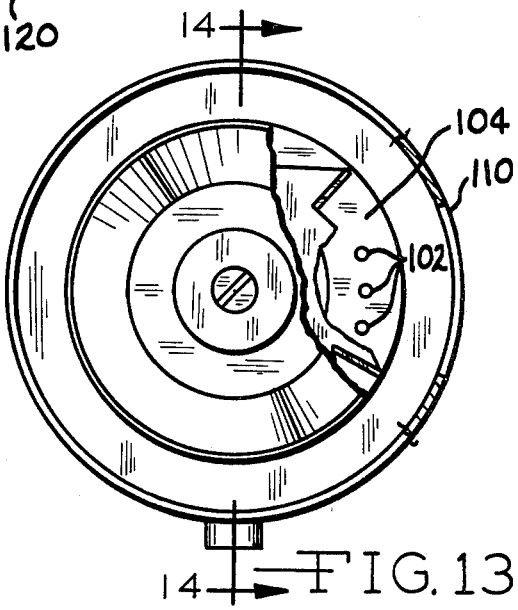
FIG. 13

ATOMIZING APPARATUS

BACKGROUND OF THE INVENTION

The present invention relates to apparatus for converting a liquid into an atomized mist and either discharging the mist directly to the atmosphere in various selected spray patterns or discharging the mist into an air stream for spraying the mist onto a receiving surface.

It is known in the art to provide an atomizing device in association with a container of liquid by which the liquid is converted to a mist and the mist is discharged from the apparatus in a gaseous stream. Apparatus of this type is well known as disclosed, for example, in U.S. Pat. No. 1,714,129, patented May 21, 1929. In apparatus of this character, the air or gas may be used to inject the liquid into the air of gas stream in which aspirating action converts the liquid into a mist to be transported in the air or gas stream from the apparatus.

Existing paint spray equipment atomizes relatively viscous liquids using either compressed air or airless high pressure pumps for carrying out the atomization of the liquid. The compressed air sprayers require bulky compressors, hoses, and a spray gun mechanism. The airless sprayers use precision high pressure pumps that require frequency maintenance. These types of apparatus are costly and inefficient for the work that they are capable of performing.

SUMMARY OF THE INVENTION

The present invention provides an improved apparatus for converting a liquid into an atomized mist, the apparatus being characterized by its compact size, few parts, light weight, low cost, ease of servicing and efficient use of energy. To achieve these characteristics, the apparatus is constructed and arranged so that the liquid is converted to a fine mist by a unique mechanical operation as distinguished from the fluidic operations generally employed in the prior art apparatus.

According to the present invention, apparatus is provided for converting a liquid into an atomized mist comprising an orifice head having a surface in which one or more orifices are located for discharge of the liquid from the head, means are provided for causing a liquid to emerge in streams from the orifice, a blade is mounted adjacent to the head for rapid movement on said surface across said orifices contacting liquid emerging from the orifices to shear particles of liquid from the main stream of liquid and discharge the particles to form a fine mist, and blade actuating means are provided to move the blade rapidly on said surface across the orifices. In a preferred form of the invention when a plurality of orifices are used, the orifices are arranged in the head so as to be in a circular path on said surface, and said blade is mounted for rotation about the center of said path so that the fine mist is discharged outwardly by the rotating blade.

In one form of the invention, an airstream housing is provided which is open at its ends. The airstream housing encloses the outer periphery of the head and is in spaced relationship thereto. Air propulsion means direct air at high velocity through the space between the housing and the head to transport the fine mist away from the head. In this form of the invention, the blade is mounted on a shaft that extends coaxially through the head and the circular path, and the blade actuating means is a motor mounted at the rearward side of the head and is connected to the shaft for imparting rotation thereto.

A container for the liquid is preferable mounted adjacent to the airstream housing, and a conduit means maintains the container in communication with the head and with the housing so that the liquid in the container is responsive to pressure from the air propulsion means to feed the liquid into the head for then emerging from the orifices. A flow control means is located in the conduit means for regulating the rate that the liquid is fed to the head.

The air propulsion means may be independently operated, or the air propulsion means may include a fan mounted in the airstream housing and driven by the same motor that serves to rotate the blade.

Various types of blades may be used. One type that is satisfactory is a blade having a saw tooth outer periphery, each saw tooth having a leading edge in engagement with the surface of the head containing the one or more orifices for shearing particles of liquid from the streams of liquid emerging from the orifices. Another type of blade which is very satisfactory is a disk with a stub tooth outer periphery, each stub tooth being partially offset from the plane of the disk and having a leading edge for engagement with the surface of the head for shearing particles of liquid emerging from the orifices.

The present invention can be utilized to discharge the atomized mist into the surrounding atmosphere in which event the airstream housing and fan are not required, and it can also be used to spray liquids, such as paint, onto receiving surfaces. In this type of apparatus the force of the emergent spray will carry the mist to a receiving surface radially in line with the rotating blade. In another form, the emergent spray may be directed or conveyed by an airstream to a receiving surface.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 12 is a perspective view with a portion broken away for illustration purposes of another embodiment of the present invention wherein a liquid can be sprayed onto a surface in the absence of an air stream;

FIG. 13 is a fragmentary front elevational view of the embodiment of FIG. 12; and FIG. 14 is a sectional view taken on the line 14—14 of FIG. 13.

DESCRIPTION OF THE PREFERRED EMBODIMENTS

Figure 1:
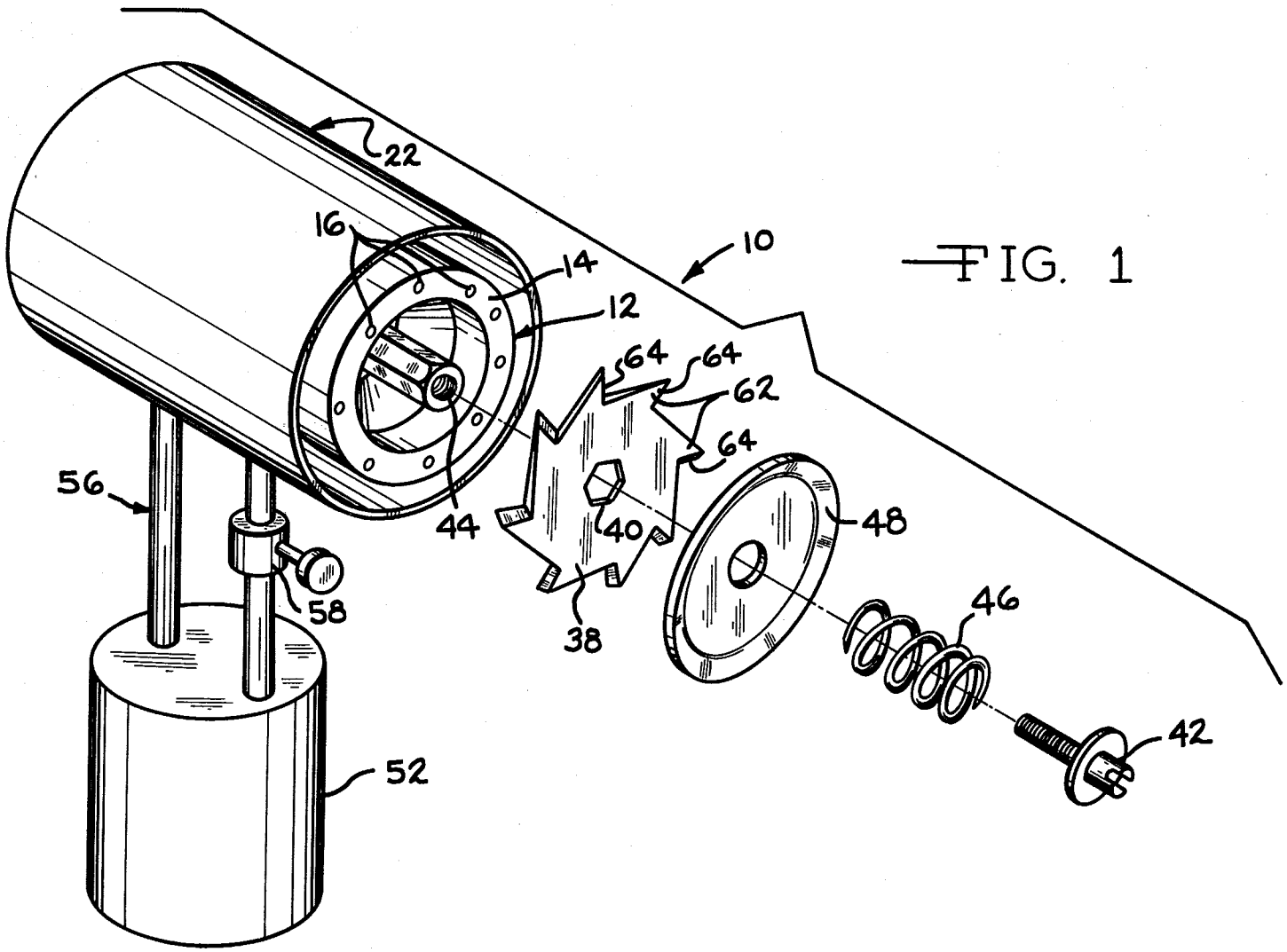
FIG. 1 is an exploded perspective view of one form of apparatus embodying the present invention wherein the mist can be sprayed onto a surface.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The apparatus 10 embodies one form of the present invention and includes an orifice head 12 that has a front flat surface 14 that provides a circular path in which a plurality of orifices 16 are located. An annular duct 18 is located within the orifice head 12 immediately adjacent to the circular path to facilitate discharge of the liquid from duct 18 through the orifices 16. A conduit 20 communicates with the annular duct 18 for supplying liquid thereto.

The airstream housing 22 has a central support member 26 with a series of ports 28 through which the air stream can flow and which is constructed and arranged to support a blade actuating means or motor 30 that can be electrically driven at high speed, such as at a rate of 25,000 rpm. The orifice head 12 is suitably fastened to the front of the motor 30, as by the fasteners 32. The motor 30 is drivingly connected to the rotary shaft 34 which has a hexagonal configuration 36 at its forward end. The shaft 34 is coaxially disposed with respect to the orifice head 12 and has mounted thereon a blade 38 for rotation therewith. The blade 38 is retained in place for rotation with shaft 34 by virtue of the fact that blade 38 has a hexagonal opening 40 at its center which is arranged to fit onto the hexagonal portion 36 of the shaft 34, and a screw fastener 42 is threadedly connected to the bore 44 in the shaft 34 and acts against the compression spring 46 and the turbulence shield 48 to urge the blade 38 against the surface 14 of the stationary orifice head 12. The shaft 34 or a suitable extension thereof also extends to the rear of the motor 30, and a fan 50 is mounted thereon to provide the air stream that flows through the housing 22 when the motor 30 is energized.

A container 52 for the liquid 54 is mounted adjacent to the housing 22 and conduit means 56, including in this instance the conduit 20, the flow control valve means 58 and the air conduit 60, provides communication with the head 12 and the interior of the housing 22 so that the liquid 54 in the container 52 is responsive to pressure, as indicated by arrows 53, from the air propulsion means 50 to feed the liquid 54 into the head 22 where it can emerge from the orifices 16.

As can be seen best in FIG. 1, the blade 38 is a disk which has a saw-tooth outer periphery, each saw tooth 62 having a leading edge 64 that extends generally radially in respect to the axis of the shaft 34 and travels in engagement with the surface 14 of the head 12. Each saw tooth 64 travels in the circular path containing the orifices 16 so that when the streams of liquid 54 emerge from the orifices 16, the leading edges 64 will shear particles of liquid from the streams of liquid 54 as can be seen sequentially in FIGS. 3–7, inclusive, so as to throw the sheared particles of liquid generally radially outwardly from the head 12.

Figure 2:
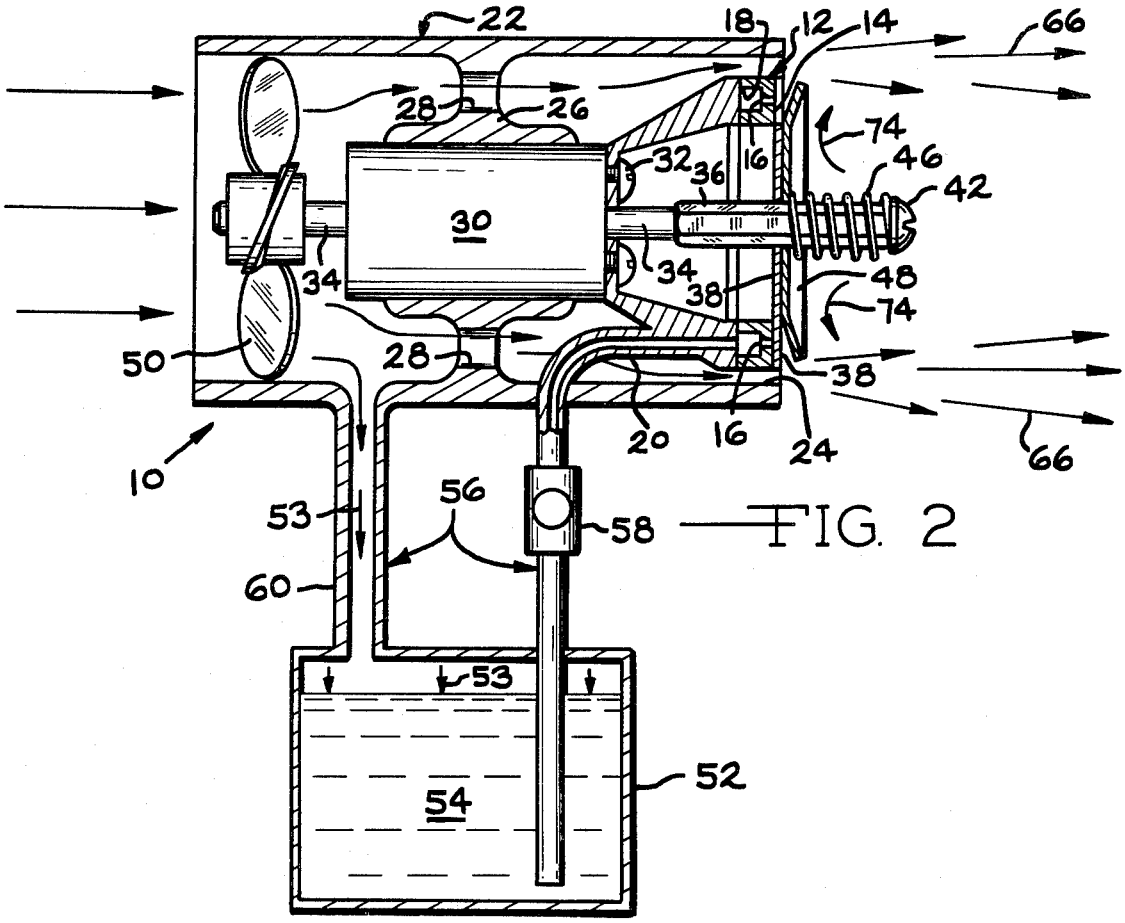
FIG. 2 is a vertical section taken through the apparatus of FIG. 1.
Figure 3:
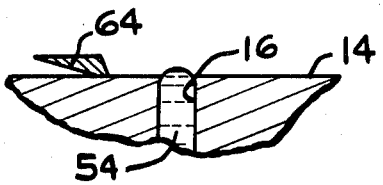
FIGS. 3 through 7 are fragmentary enlarged sectional views through one of the orifices in the head, showing sequential steps of the blade as it shears particles of the liquid from the main stream of the liquid.
Figure 4:
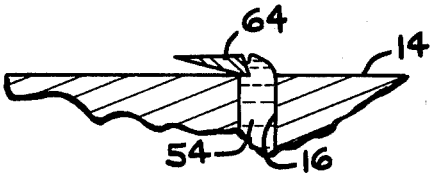
Figure 5:
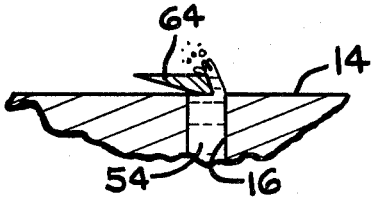
Figure 6:
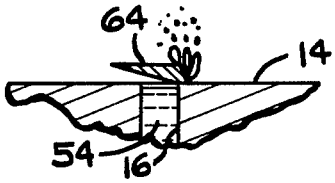
Figure 7:
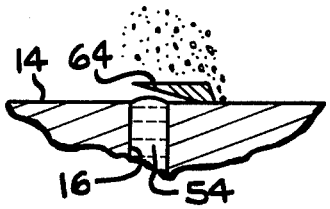

In the form of the invention shown in FIG. 2, the sheared particles of liquid constitute a fine mist that is discharged into the air stream that flows through the annular passageway 24 from which the air emerges at high velocity to transport the liquid particles or atomized mist. As indicated by the arrows 66, the mixture of liquid particles and air will flow in a desired pattern for deposit upon a wall surface or the like upon which the liquid in the airstream can be controlled by the setting that is made of flow control valve 58.

Figure 8:
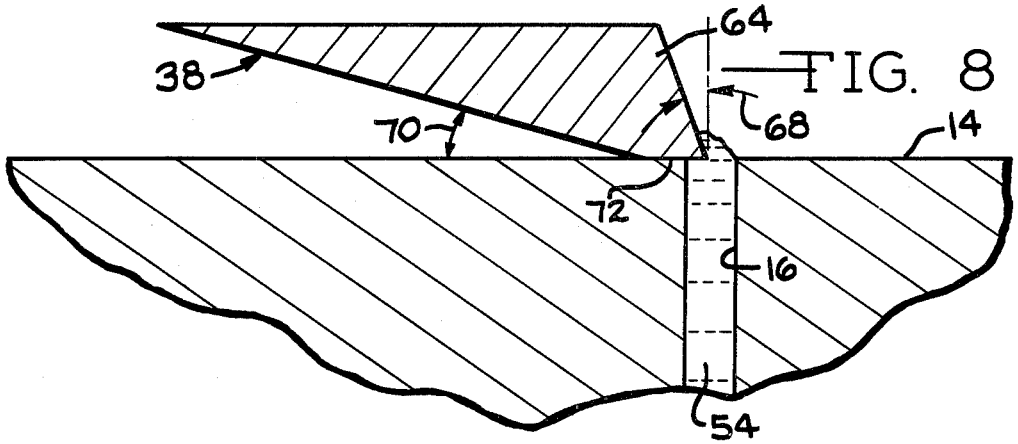
FIG. 8 is an enlarged sectional view similar to FIGS. 3 through 7, illustrating details of construction of one form of the blade.

To provide the most effective shearing action of the liquid 54 resulting from the rotary action of the blade 38 it is found most desirable to provide each saw tooth with a leading edge having a positive rake angle of approximately twenty degrees at 68 and minimum relief angle of approximately ten degrees at 70, as shown in FIG. 8. It is also found desirable to provide a flat area at 72 for travel on the surface 14 that has a limited dimension in a circumferential direction of approximately 2/100 of an inch when used in conjunction with orifices 16 having approximately this diameter.

It is found desirable to utilize a turbulence shield 48 for deflecting the radial flow of air from blade 38 away from the blade tips as shown by the arrows 74 in FIG. 2. In the absence of the turbulence shield 48, aerodynamic vortex turbulence may occur at the blade tips forcing the atomized mist rearwardly toward the outer edge of the airstream housing 22.

Figure 9:
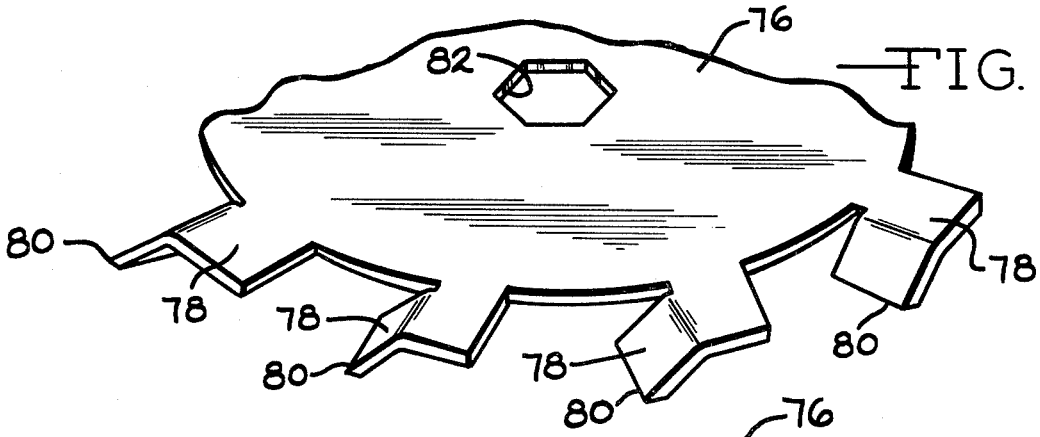
FIG. 9 is an enlarged fragmentary perspective view of another form of a blade that may be used in the present invention.
Figure 10:
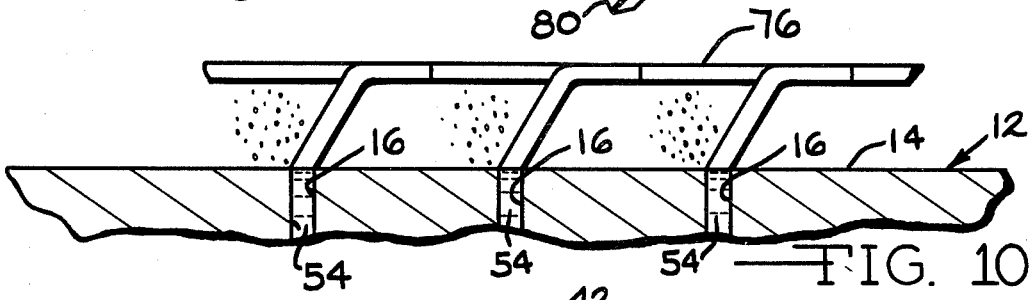
FIG. 10 is a fragmentary vertical section taken through a series of the orifices and the blade of the form shown in FIG. 9.

Another form of blade that has proved to be especially beneficial when used in the present invention is the blade 76 illustrated in FIGS. 9 and 10. This form of blade is a disk with a stub-tooth outer periphery, each stub tooth 78 having a leading edge 80 in engagement with the flat surface 14 and extending generally in a radially direction in respect to the axis of the shaft 34 for shearing particles of liquid from the streams of liquid 54 emerging from the orifices 16. This blade has excellent wear characteristics and can be inexpensively manufactured. As in the blade 38, the blade 76 also as a hexagonal opening 82 which can fit onto the hexagonal portion 36 of the shaft 34 so that the blade 36 rotates with shaft 34 when the motor 30 is energized. A fastening screw 42 and compression spring 46 may be used to mount the blade 76 on the shaft 34.

Figure 11:
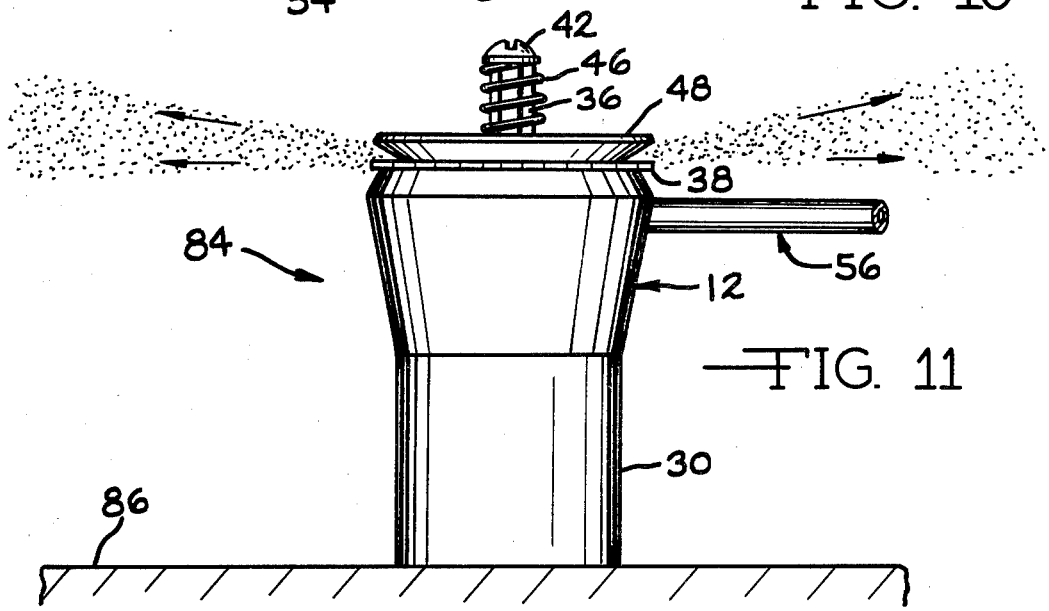
FIG. 11 is an elevational view of apparatus embodying the present invention wherein the mist is discharged into the atmosphere in the absence of an air stream.

FIG. 11 shows another form of the invention wherein the apparatus 84 is mounted on a supporting surface 86 and the airstream housing 22 has been omitted. In this form of the invention, the streams of liquid are sheared by the blade 38 and are discharged from the head 12 in a generally radial direction as a fine mist into the surrounding atmosphere. The blade 38 of this form of the invention also has a leading edge having a positive rake angle as can be seen best in FIG. 10. The head 12 can be mounted directly on the end of the motor 30 and the liquid can be supplied to the head 12 by means of the liquid supply means 56. The motor 30 is preferably an electric motor that can rotate at high speeds, such as 25,000 rpm, to actuate the blade 38. Apparatus 84 is desirable for use when atomization of a liquid for discharge into the atmosphere is required.

FIGS. 12–14 show another form of the invention wherein the apparatus 88 can be used to apply a liquid, such as paint, onto a receiving surface without utilizing an airstream to transport the atomized mist. The apparatus 88 includes an orifice head 90, blade 92, turbulence shield 94, shaft 96, compression spring 98, screw-fastener 100 and motor 101 that are constructed and arranged essentially the same as the corresponding parts of the embodiment of FIGS. 1 and 2. In this form of the invention, orifices 102 are located at front surface 104 adjacent to aperture 110.

The apparatus 88 also includes a casing 106 that has a removable cover 108 and encloses the blade 92 and the front surface 104 of the orifice head 90 to restrict discharge of the atomized mist. The casing 106 has an aperture 110 in the form of an arcuate slot that is located generally radially outwardly of the blade 92 and the orifices 102 so that some of the fine mist generated by the rotating blade 92 can be discharged from the casing 106 to provide a fan-shaped spray as indicated by the broken lines 112 in FIG. 12.

The casing 106 has a drain port 114 for drainage of the atomized mist that was not discharged through the aperture 110, and the collected liquid of this character flows through the drainage means or duct 116 to the liquid supply means 118.

The liquid supply means 118 includes the container 120 for storage of the liquid, a pump 122 for pumping liquid from the container 120 to the head 90, and conduit means 124 between both the container 120 and the pump 122 and the pump 122 and the head 90. The portion of the conduit means 124 between the pump 122 and the head 90 includes a flow control valve 126 for regulating the flow of the liquid to the head 90 and thereby the flow of the atomized mist at 112. In this form of the invention, the pump 122 is driven by the motor 102, but in other forms of the invention the pump may be separately driven.

It is claimed:

1. Apparatus for converting a liquid into an atomized mist from an orifice head having a surface in a flat plane in which at least one orifice is located for discharge of a liquid from the head, and liquid supply means are associated with the head for causing a liquid to emerge in a stream from each said orifice, characterized in that a blade is mounted adjacent to said head for rapid continuous movement on said surface across said orifice to contact liquid emerging from said orifice to shear particles of liquid from the main stream of liquid emerging from said orifice and discharge the particles therefrom as a fine mist, said blade having a flat area for riding on said surface and a leading edge for contacting the emerging liquid, said leading edge defining a rake angle relative to said surface, and blade-actuating means to move said blade rapidly on said surface repeatedly across said orifice so that said leading edge repeatedly contacts said emerging liquid.

2. The apparatus that is defined in claim 1, and further characterized in that a plurality of orifices are arranged in said head so as to be in a circular path on said surface, and said blade is mounted for rotation about the center of said path so that said fine mist is discharged radially outwardly by the rotating blade.

3. The apparatus that is defined in claim 2, and further characterized in that biasing means engages said blade to urge the blade continuously against said surface.

4. The apparatus that is defined in claim 2, and further characterized in that said orifice head has a duct therein immediately adjacent to said circular path and in communication with said orifices and with said means for causing a liquid to emerge from said orifices.

5. The apparatus that is defined in claim 1 or claim 2, and further characterized in that a casing encloses said blade and said surface of said head, said casing having an aperture located so that at least a portion of said fine mist can pass through the aperture to provide a spray of a desired shape emanating from the aperture.

6. The apparatus that is defined in claim 2, and further characterized in that a casing encloses said blade and said surface of said head, said casing having an arcuate slot located generally radially outwardly of said blade and at least some of said orifices so that some of said fine mist will be discharged through said arcuate slot to provide a fan-shaped spray.

7. The apparatus that is defined in claim 6, and further characterized in that drain means are in communication with both said casing and said liquid supply means for return of liquid from said casing to said liquid supply means.

8. The apparatus that is defined in claim 7, and further characterized in that said liquid supply means includes a container for storage of said liquid, a pump for pumping liquid from said container to said head, and conduit means between said pump and said container and between said pump and said head through which the pumped liquid can flow.

9. The apparatus that is defined in claim 8 and further characterized in that a flow-control valve is located in said conduit means for regulating the flow of the liquid to said head.

10. Apparatus for converting a liquid into an atomized mist from an orifice head having a surface in which a plurality of orifices are arranged so as to be in a circular path on said surface for discharge of a liquid from the head, and liquid supply means are associated with the head for causing a liquid to emerge in a stream from each said orifice, characterized in that a blade is mounted adjacent to said head for rapid movement on said surface across said orifice to contact liquid emerging from said orifice to shear particles of liquid from the main stream of liquid emerging from said orifice and discharge the particles therefrom as a fine mist, said blade being mounted for rotation about the center of said path so that said fine mist is discharged radially outwardly by the rotating blade, blade-actuating means to move said blade rapidly on said surface across said orifice, and an airstream housing open forward of said head enclosing in spaced relationship the radially outer periphery of said head, and air propulsion means for directing air through the space between said housing and said head to transport said fine mist away from said head.

11. The apparatus that is defined in claim 10, and further characterized in that said blade is mounted on the forward end of a shaft that extends coaxially in a rearward direction through said head and said circular path, and said blade-actuating means is a motor mounted at the rearward side of said head and connected to said shaft for imparting rotation thereto.

12. The apparatus that is defined in claim 10, and further characterized in that a container for the liquid is mounted adjacent to said housing, and conduit means maintain said container in communication with said head and with said housing so that the liquid in said container is responsive to pressure from the air propulsion means to feed the liquid into said head for emerging from said orifice.

13. The apparatus that is defined in claim 12, and further characterized in that a flow control means is located in said conduit means for regulating the rate that liquid is fed to said head.

14. The apparatus that is defined in claim 10, and further characterized in that said blade is mounted on the forward end of a shaft that extends coaxially in a rearward direction through said head and said circular path, said blade-actuating means is a motor mounted on the rearward side of said head and connected to said shaft for imparting rotation thereto, and said air propulsion means is a fan driven by said motor.

15. Apparatus for converting a liquid into an atomized mist from an orifice head having a surface in which a plurality of orifices are arranged so as to be in a circular path on said surface for discharge of a liquid from the head, and liquid supply means are associated with the head for causing a liquid to emerge in a stream from each said orifice, characterized in that a blade is mounted adjacent to said head for rapid movement on said surface across said orifice to contact liquid emerging from said orifice to shear particles of liquid from the main stream of liquid emerging from said orifice and discharge the particles therefrom as a fine mist, said blade being mounted for rotation about the center of said path so that said fine mist is discharged radially outwardly by the rotating blade, blade-actuating means to move said blade rapidly on said surface across said orifice, said blade having a plurality of tips adjacent to its radially outer periphery and a turbulence shield is mounted adjacent to said blade to shield and redirect the radial air flow on said blade away from said tips of the blade.

16. Apparatus for converting a liquid into an atomized mist from an orifice head having a surface in which a plurality of orifices are arranged so as to be in a circular path on said surface for discharge of a liquid from the head, and liquid supply means are associated with the head for causing a liquid to emerge in a stream from each said orifice, characterized in that a blade is mounted adjacent to said head for rapid movement on said surface across said orifice to contact liquid emerging from said orifice to shear particles of liquid from the main stream of liquid emerging from said orifice and discharge the particles therefrom as a fine mist, said blade being mounted for rotation about the center of said path so that said fine mist is discharged radially outwardly by the rotating blade, blade-actuating means to move said blade rapidly on said surface across said orifice, said blade being mounted on a shaft for rotation, said blade being a disk with saw-teeth adjacent to its outer periphery, each saw tooth having a leading edge in engagement with said surface and extending generally in a radial direction for shearing particles of liquid from the streams of liquid emerging from said orifices.

17. The apparatus that is defined in claim 6, and further characterized in that each saw tooth has a leading edge with a positive rake angle.

18. The apparatus that is defined in claim 16, and further characterized in that each saw tooth has a flat base extending a relatively short distance rearwardly in a circumferential direction from said leading edge for travel on said surface and an inclined surface extending from said flat base at an inclined angle with said flat base to provide a relief angle.

19. Apparatus for converting a liquid into an atomized mist from an orifice head having a surface in which a plurality of orifices are arranged so as to be in a circular path on said surface for discharge of a liquid from the head, and liquid supply means are associated with the head for causing a liquid to emerge in a stream from each said orifice, characterized in that a blade is mounted adjacent to said head for rapid movement on said surface across said orifice to contact liquid emerging from said orifice to shear particles of liquid from the main stream of liquid emerging from said orifice and discharge the particles therefrom as a fine mist, said blade being mounted for rotation about the center of said path so that said fine mist is discharged radially outwardly by the rotating blade, blade-actuating means to move said blade rapidly on said surface across said orifice, said blade being mounted on a shaft for rotation, said blade being a disk with stub-teeth adjacent to its outer periphery, each stub tooth having a leading edge in engagement with said surface and extending generally in a radial direction for shearing particles of liquid from the streams of liquid emerging from said orifices.

20. The apparatus that is defined in claim 19, and further characterized in that each stub tooth has a leading edge portion inclined out of the plane of said disk to provide said leading edge, each said inclined portion facing in the direction of rotation of said disk so that when the disk is rotated the reactionary force of the air engaged by the inclined portion will provide an axial component of force urging the leading edge against said surface.

21. The apparatus that is defined in claim 19, and further characterized in that each stub tooth has a flat base extending a relatively short distance rearwardly in a circumferential direction from said leading edge for travel on said surface.

22. Apparatus for converting a liquid into an atomized mist from an orifice head having a surface in which a plurality of orifices are arranged so as to be in a circular path on said surface for discharge of a liquid from the head, a liquid supply means are associated with the head for causing a liquid to emerge in a stream from each said orifice, characterized in that a blade is mounted adjacent to said head for rapid movement on said surface across said orifice to contact liquid emerging from said orifice to shear particles of liquid from the main stream of liquid emerging from said orifice and discharge the particles therefrom a fine mist, said blade being mounted for rotation about the center of said path so that said fine mist is discharged radially outwardly by the rotating blade, blade-actuating means to move said rapidly on said surface across said orifice, said blade being mounted on the forward end of a shaft that extends coaxially in a rearward direction through said head and said circular path, said blade-actuating means being a motor mounted at the rearward side of said head and connected to said shaft for imparting rotation thereto.

23. Apparatus for converting a liquid into an atomized mist from an orifice head having a surface in which a plurality of orifices are arranged so as to be in a circular path on said surface for discharge of a liquid from the head, and liquid supply means are associated with the head for causing a liquid to emerge in a stream from each said orifice, characterized in that a blade is mounted adjacent to said head for rapid movement on said surface across said orifice to contact liquid emerging from said orifice to shear particles of liquid from the main stream of liquid emerging from said orifice and discharge the particles therefrom as a fine mist, said blade being mounted for rotation about the center of said path so that said fine mist is discharged radially outwardly by the rotating blade, blade-actuating means to move said blade rapidly on said surface across said orifice, a casing enclosing said blade and said surface of said head, said casing having a arcuate slot located generally radially outwardly of said blade and at least some of said orifices so that some of said fine mist will be discharged through said arcuate slot to provide a fan-shaped spray, drain means in communication with both said casing and said liquid supply means for return of liquid from said casing to said liquid supply means, said liquid supply means including a container for storage of said liquid, a pump pumping liquid from said container to said head, and conduit means between said pump and said container and between said pump and said head through which the pumped liquid can flow, said pump being operatively connected to said blade-actuating means to be rotated thereby.

* * * * *